US005732541A

United States Patent [19]

Kunzelman

[11] Patent Number: 5,732,541

[45] Date of Patent: Mar. 31, 1998

[54] METHOD AND APPARATUS FOR MAKING FILAMENT ROPE

[75] Inventor: Richard J. Kunzelman, Geneva, Ill.

[73] Assignee: Ambar, Inc., Lafayette, La.

[21] Appl. No.: 530,061

[22] Filed: Sep. 19, 1995

[51] Int. Cl.[6] ..... D02G 3/36

[52] U.S. Cl. ..... 57/7; 87/1; 87/3; 87/5; 87/12; 87/13; 87/23; 87/28

[58] Field of Search ..... 87/1, 3, 4, 5, 7, 87/12, 13, 23, 28, 11; 57/7

[56] References Cited

U.S. PATENT DOCUMENTS

| | | | |
|---|---|---|---|
| 279,997 | 6/1883 | Waring . | |
| 1,098,257 | 8/1914 | Healy | 87/23 |
| 1,990,028 | 2/1935 | Horn . | |
| 3,975,980 | 8/1976 | Hood | 87/6 |
| 4,311,079 | 1/1982 | Hood | 87/6 |
| 4,754,685 | 7/1988 | Kite et al. | 87/9 |
| 5,027,594 | 7/1991 | Gamberoni et al. | 57/24 |
| 5,067,384 | 11/1991 | Scala | 87/6 |

*Primary Examiner*—William Stryjewski

*Attorney, Agent, or Firm*—John L. Schmitt

[57] ABSTRACT

A filament rope may be produced continuously by the method and apparatus of this invention. In an upper portion of a frame of the apparatus is a unit having strand carrying spools that move about to braid the strands into a core of the rope. During braiding the strands overlap to form sets of pairs of transversely aligned openings which decrease in size as the rope core is drawn away from the braiding unit by a tension wheel assembly. While the openings are still large, a filament length carried by a first cylinder passes through one pair of strand openings. The cylinder then is withdrawn and the filament length severed leaving a filament segment in that pair of openings. Next, a second filament segment is placed in the other strand opening pair by a second cylinder. After filament segment insertion a tamping tool engages the strands and inserted filament segments to promote opening size reduction and improve formation of a compressive fit by the strands on the filament segments. The filament carrying rope core next may travel through a heating unit that softens the filament segments for crimping by a set of reciprocating rings. As crimped, the filament segments form an array about the core particularly adapted for absorbing liquid wastes.

10 Claims, 13 Drawing Sheets

FIG. 1
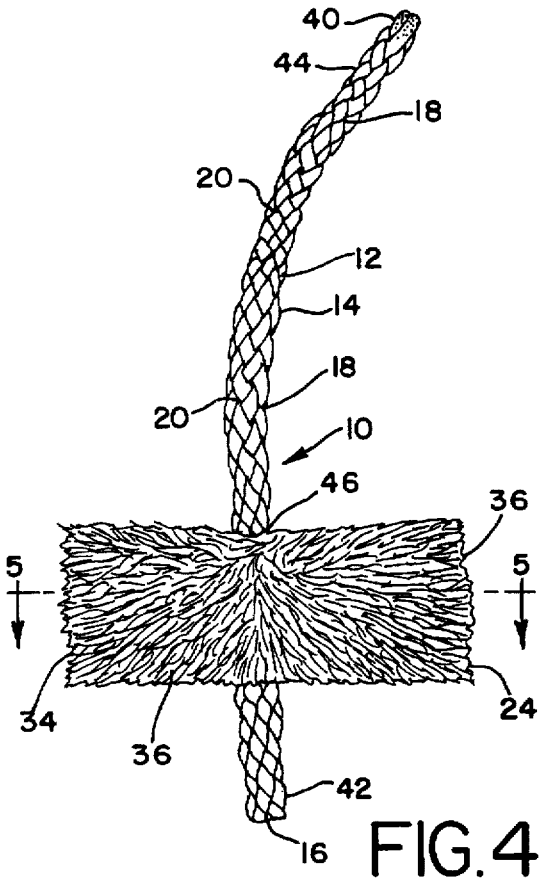
FIG. 2
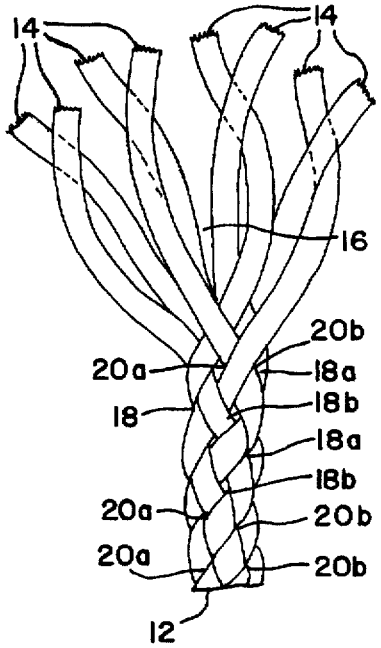
FIG. 3
FIG. 4
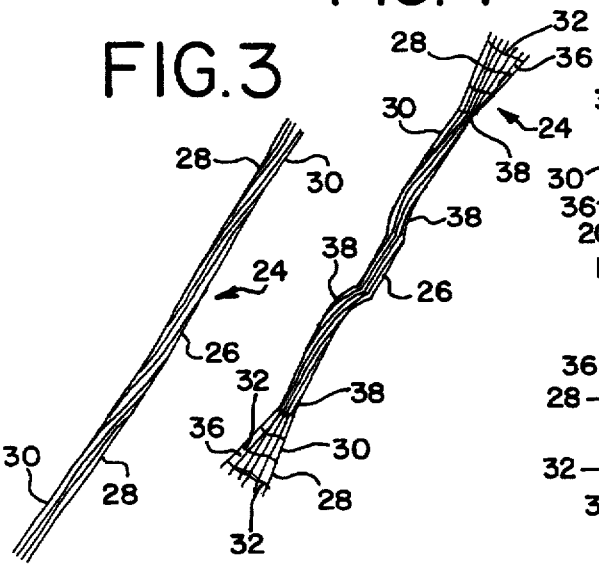
FIG. 5
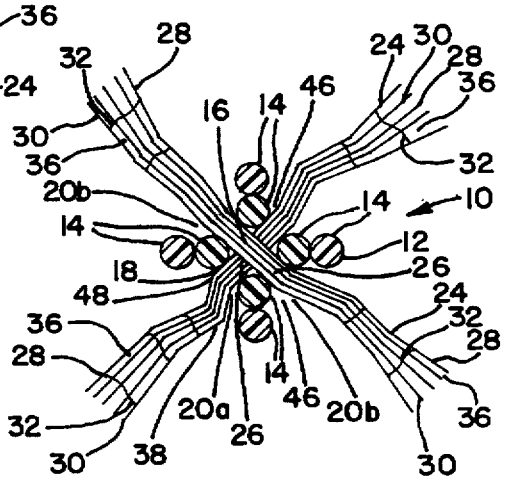

82
78
80
83
102
72
88
74
74
70
300
68
76
114
298
118
296
64
8
116
52
76
306
14
14
310
10
10
308
120
304
96
92
122
312
98
94
156
74
158
364
364
62
350
356
8
V
362
350
352
364
66

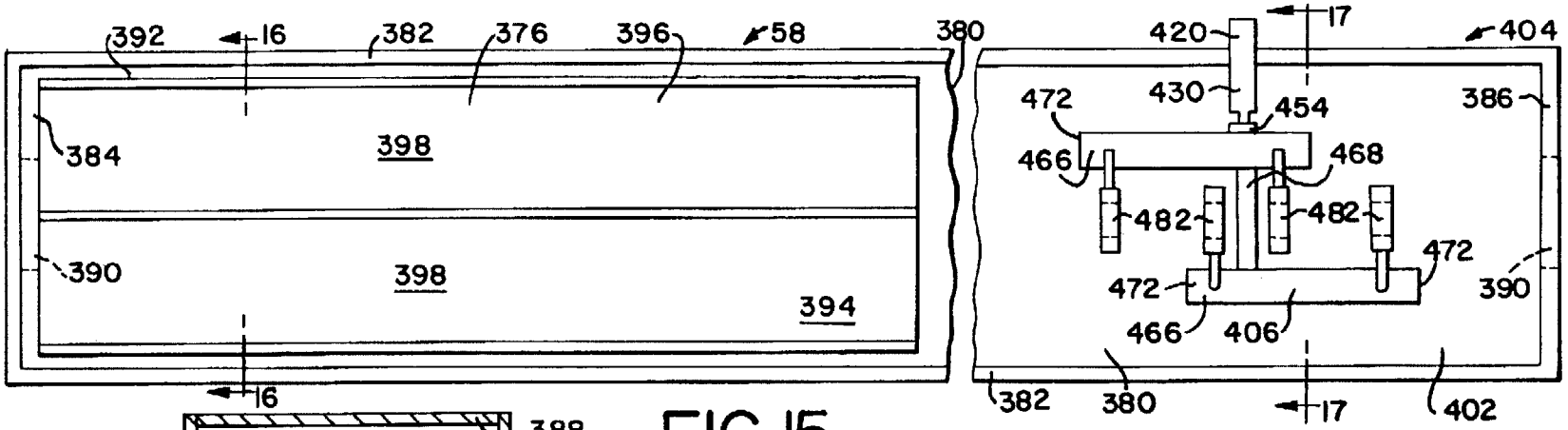
FIG. 13
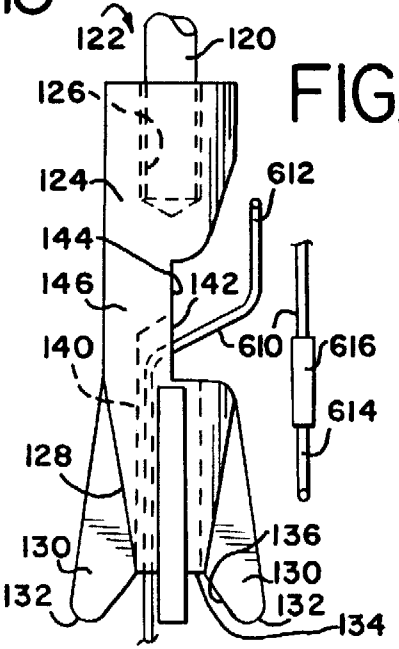
FIG. 14
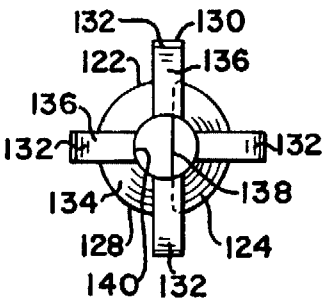
FIG. 15
FIG. 16
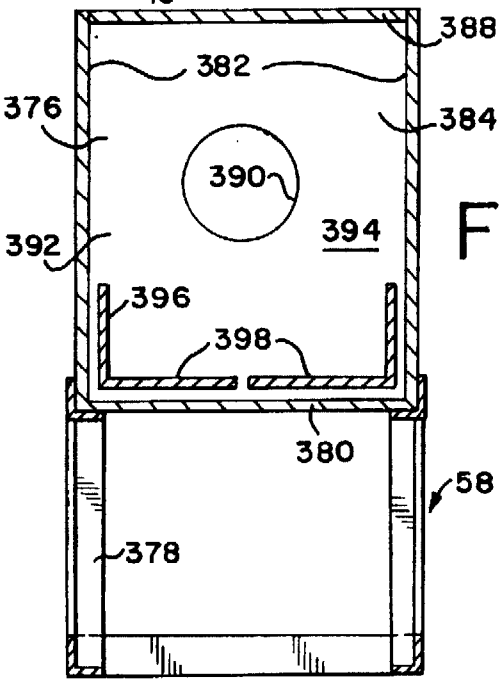

60
29
29
364
366
368
370
586
584
590
588
550
562
560
558
556
554
526
522
528
514
516
520
530
74
524
304
564
534
532
540
518
568
570
572
574
576
580
630

METHOD AND APPARATUS FOR MAKING FILAMENT ROPE

BACKGROUND OF THE INVENTION

1. Field of Invention

This invention relates to methods and apparatus for making filament rope and more particularly to methods and apparatus which forms a rope comprising a braided core having filament segments extending outward through openings in the core to define a filament array about the core.

2. Prior Art

One early example of apparatus for manufacturing a rope-like structure containing outward extending filament-like threads is disclosed in U.S. Pat. No. 279,997. In this case a core of the rope comprises a pair of strands which are twisted as they pass through a conduit for a stream of air carrying threads. During twisting, the strands capture threads from the air stream. The core and captured threads emerge from the conduit with a naplike structure. A comparable napped rope structure from like functioning apparatus is disclosed in U.S. Pat. No. 5,027,594.

A braiding machine which includes a feeder for introducing a supplementary thread is set out in U.S. Pat. No. 1,990,028. As this machine braids strands into a cord, the supplementary thread is fed into the rotating, intersecting strands to form a series of loops which extend outward from the core. Apparatus producing a similar result is shown in U.S. Pat. No. 4,311,079.

U.S. Pat. No. 3,975,980 sets forth a method and apparatus for making a faired article. In this case, a braider forms strands into a jacket about an underwater cable. Between the jacket and a core of the cable is a length of fairing yard. During braiding, a needle carrying the fairing yard periodically moves downstream through the path of the strands converging in a braiding zone. A gripping assembly, spaced downstream from the braiding zone, next moves upstream to snag the fairing yarn from the needle. A loop is formed as the needle then reciprocates back to its upstream position. Ends of these periodically formed loops next are severed into individual fairings. In a final step the individual fairings are subjected to heat and compression that expands and twists fibers of the fairings. A further braider modified for forming a cable jacket with fairing members is set out in U.S. Pat. No. 5,067,384.

None of the above discussed prior art teachings has been applied to making filament rope or liquid waste absorbing filament rope as disclosed in co-pending application Ser. No. 381,374 filed Jan. 31, 1995. Heretofore, such ropes have been hand formed by looping filament segments about each strand of a twisted, 3-strand rope core. A middle portion of a first filament segment is looped about a first strand, for example. Intermediate portions of this first filament segment then fit between the second and third strands so that end portions of the filament segment extend outward from the core. A second and a third filament segment then are fitted respectively about the second and third strands of the core. This cycle is repeated to form a rope having a continuous filament array thereabout.

SUMMARY OF THE INVENTION

A method and apparatus of this invention are particularly adapted to form a filament rope. In an upper portion of the apparatus is a braiding station having a unit carrying a series of strand spools. In a lower portion of the apparatus frame is a rope tension wheel assembly. Spaced between the braiding station and the tension wheel assembly is an insertion station which includes a pair of filament inserter units.

During operation of the apparatus the spools of the braiding unit travel in circular, crisscrossing paths to braid the strands dispensing from the spools into a core of the rope. As crisscrossed, the strands form pairs of aligned openings between the strands. These pairs of openings then are filled with filament segments by the inserter units of the insertion station. As the core is drawn away from the insertion station by the tension wheel assembly, the size of these openings decreases. Size reduction continues until the strands compressively hold the filament segments in place.

The apparatus further includes a tamping unit located between the braiding unit and the insertion station. This unit has a tool that periodically engages the strands defining the core openings just filled with filament segments. Action of the tool promotes opening size reduction and subsequent formation of the compressive fit about each filament segment.

To enhance absorbent qualities of the rope, applicable to one of several uses of this inventive filament rope, the apparatus includes a thermo-napping station located downstream from the tension wheel assembly. The thermo-napping station comprises a heating unit and a napping unit. The heating unit softens the filament segments so that fibers of the softened filament segments may be readily expanded and crimped by the napping unit. As expanded and crimped, the filament segments form a highly absorbent fibrous array about the core of the rope. Positioned downstream from the thermo-napping station is an idle drive unit that engages the rope to pull the rope through the thermo-napping station.

The inventive method of forming a filament rope and apparatus for carrying out this method have several advantages over methods and apparatus presently known or in use.

A first advantage of the invention is that it produces a machine-made filament rope having a high filament density. As operated, this apparatus is the first known device to form such commercial quality rope. Additionally, the method may include steps and apparatus include means to form a filament rope having a fibrous array possessing superior liquid waste absorbing qualities.

Being able to form a filament rope mechanically not only increases the amount of rope that may be made in a given period of time but also reduces manual input per unit length. These two factors combine to substantially reduce cost.

A further advantage of this inventive method and apparatus is that the formed rope has a more consistent quality. Additionally, the rope in its absorbent configuration has a higher absorbtion rate than theretofore hand-made absorbent filament ropes.

A still further advantage is that the method and apparatus of this invention may be readily adapted to form ropes comprising different size strands and different size and length filament segments. A filament rope may be tailor-made for specific uses. An ability to modify these variable is much more limited when filament ropes are hand formed.

Lastly, materials used as filament segments may be varied. If the segments were steel wire or another like stiff, abrasive material while the core strands remain a flexible synthetic material, for example, the resulting rope may be used to clean scale from heat exchanger tubing.

DESCRIPTION OF THE DRAWINGS

FIG. 1 is a perspective view of a section of rope formed by a method and apparatus of this invention.

FIG. 2 is a side elavational view of a core of the rope of FIG. 1 showing ends of strands of the rope core in an open, semi-braided state.

FIG. 3 is a detailed side elevational view of a filament segment.

FIG. 4 is a detailed view of a filament segment after thermo-napping.

FIG. 5 is a cross sectional view of the rope as seen generally along the line 5—5 in FIG. 1 showing a typical set of two pairs of aligned openings having one filament segment in each opening pair.

FIG. 13 is a side elevational view of part of a tamping unit of the apparatus of FIG. 6 and includes a tube which passes through a tamping tool of the unit to supply mastic to the rope being formed therebelow.

FIG. 14 is a bottom view of the tamping tool of FIG. 13.

FIG. 15 is a plan view of a thermo-napping station which may form part of the inventive apparatus.

FIG. 16 is a cross sectional view as seen generally along the line 16—16 in FIG. 15 showing a portion of a heating unit of the thermo-napping station.

DESCRIPTION OF THE PREFERRED EMBODIMENT

Apparatus 50 of this invention for making a filament rope 10 comprises a series of operatively connected work stations and functional units. To better appreciate this operative relationship, it is suggested that one first view FIG. 30. Additionally, structure of the rope 10, shown in FIGS. 1–5, is described in detail in co-pending application, Ser. No. 381,374 filed Jan. 31, 1995. Lastly, like reference numbers are used to identify like structure.

Figure 30:
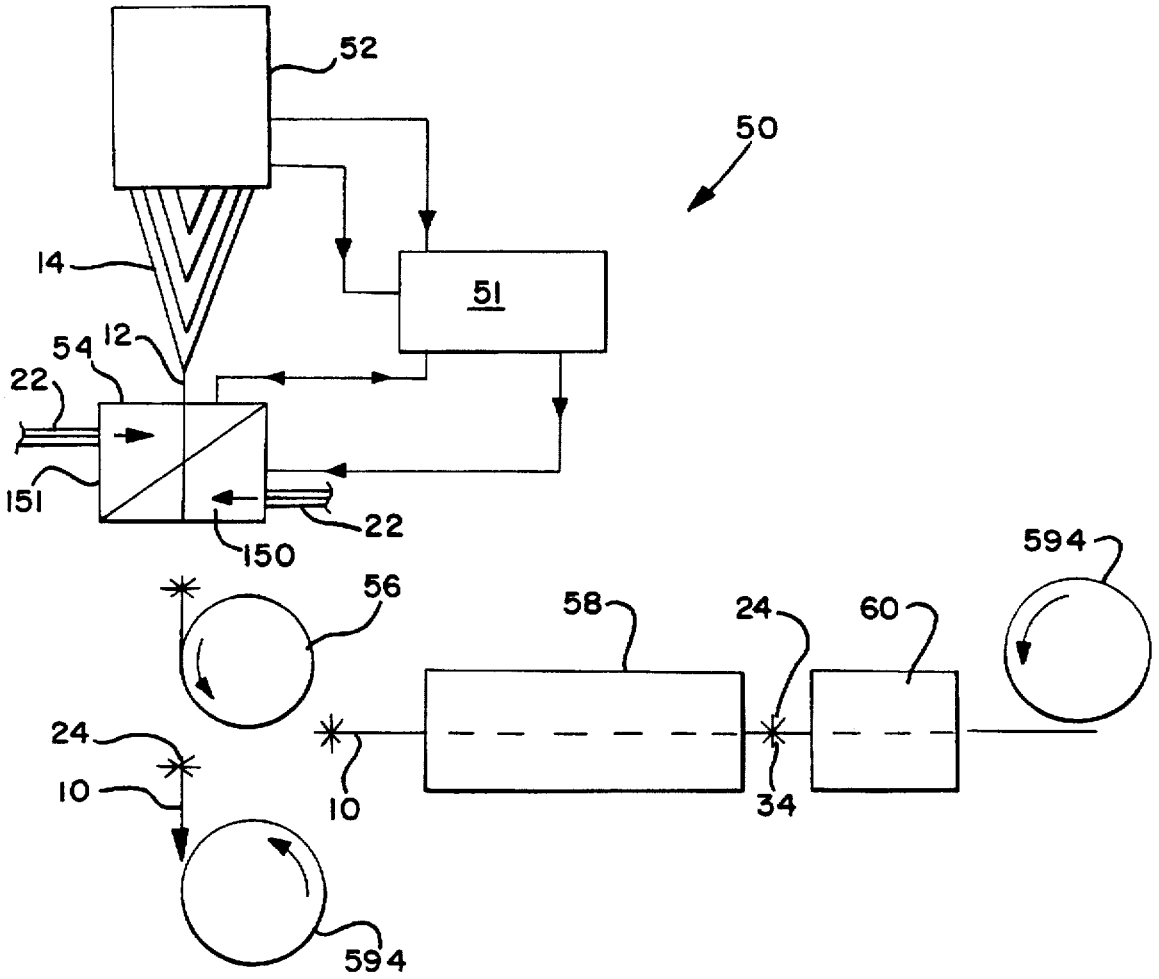
FIG. 30 is a block diagram showing the relationship of the various operative components of the apparatus.

As set out in FIG. 30, the apparatus 50 comprises a braiding station 52, a filament insertion station 54, and a tension wheel assembly 56. When the rope 10 is to have improved absorbent qualities, the apparatus 50 additionally includes an idle drive unit 60 which draws the rope 10 through a thermo-napping station 58.

Figure 6:
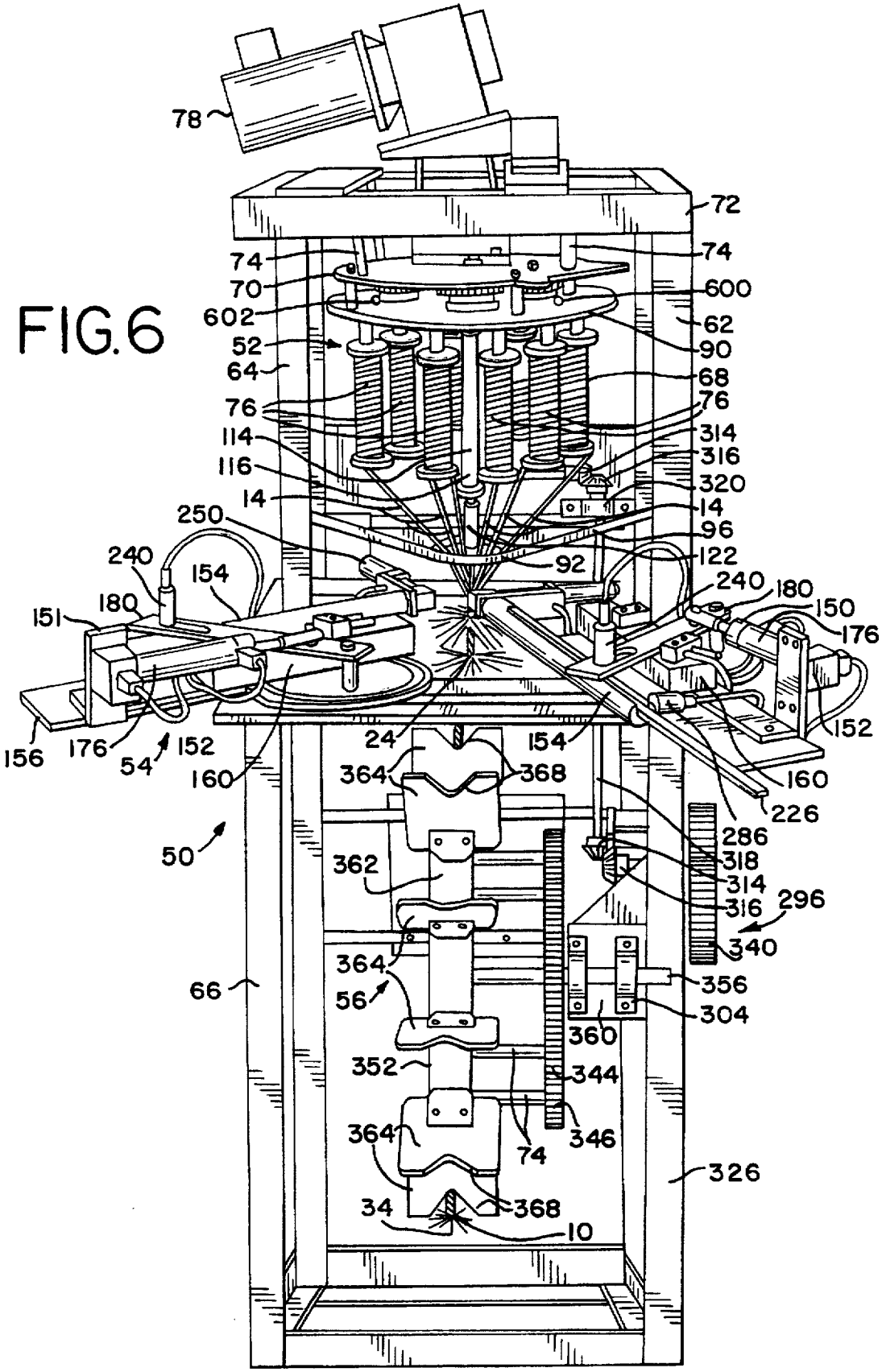
FIG. 6 is a front perspective view of a frame of the inventive apparatus wherein the frame is carrying a braiding station, an insertion station, and a tension wheel assembly.

As shown in FIG. 6, the apparatus 50 comprises a frame 62. Carried in an upper portion 64 of the frame 62 is the braiding station 52 and the insertion station 54. The tension wheel assembly 56 is located in a lower portion 66 of the frame 62.

Figure 7:
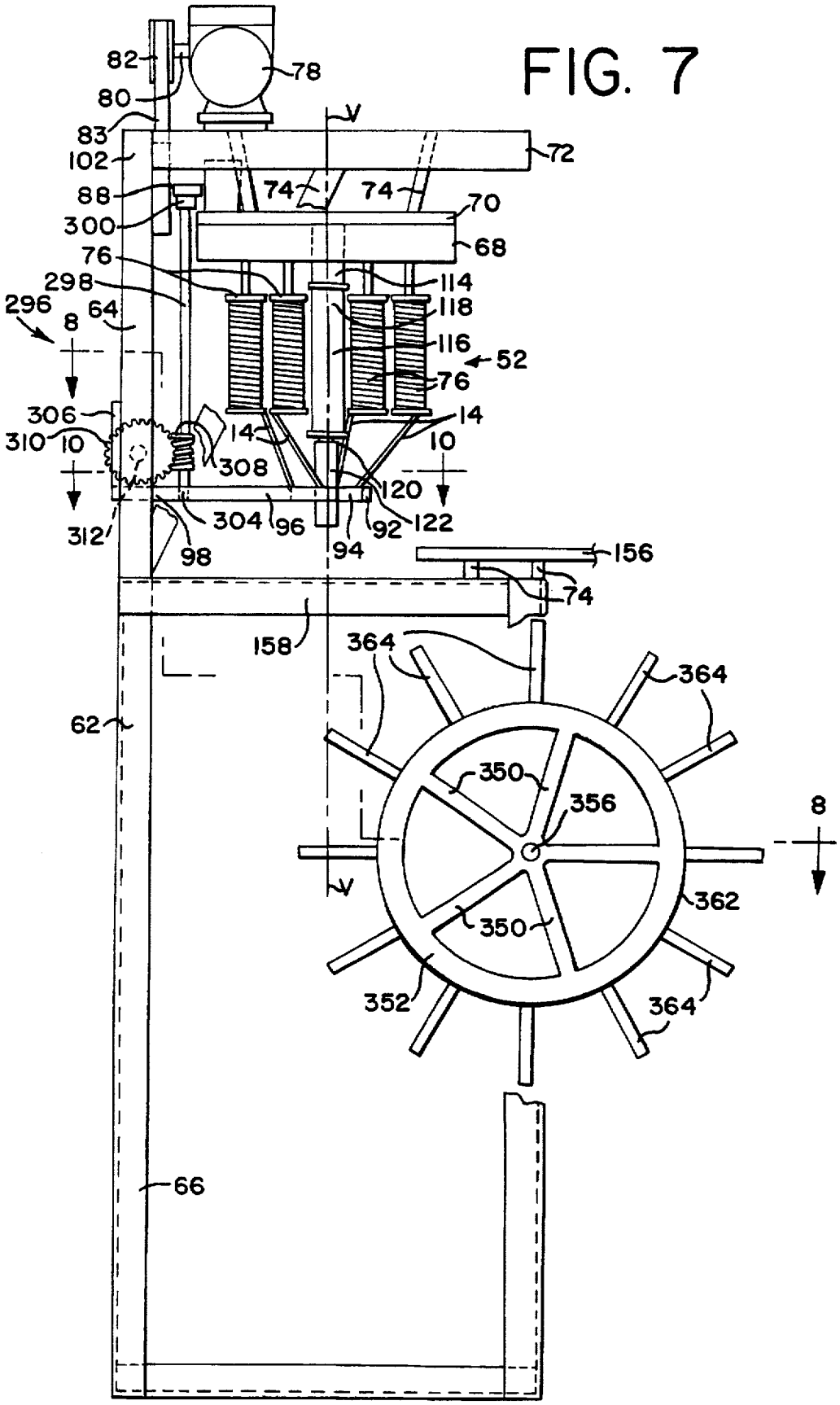
FIG. 7 is a side elevational view of the apparatus seen in FIG. 6; certain apparatus structure is deleted for the purpose of explanation.
Figure 9:
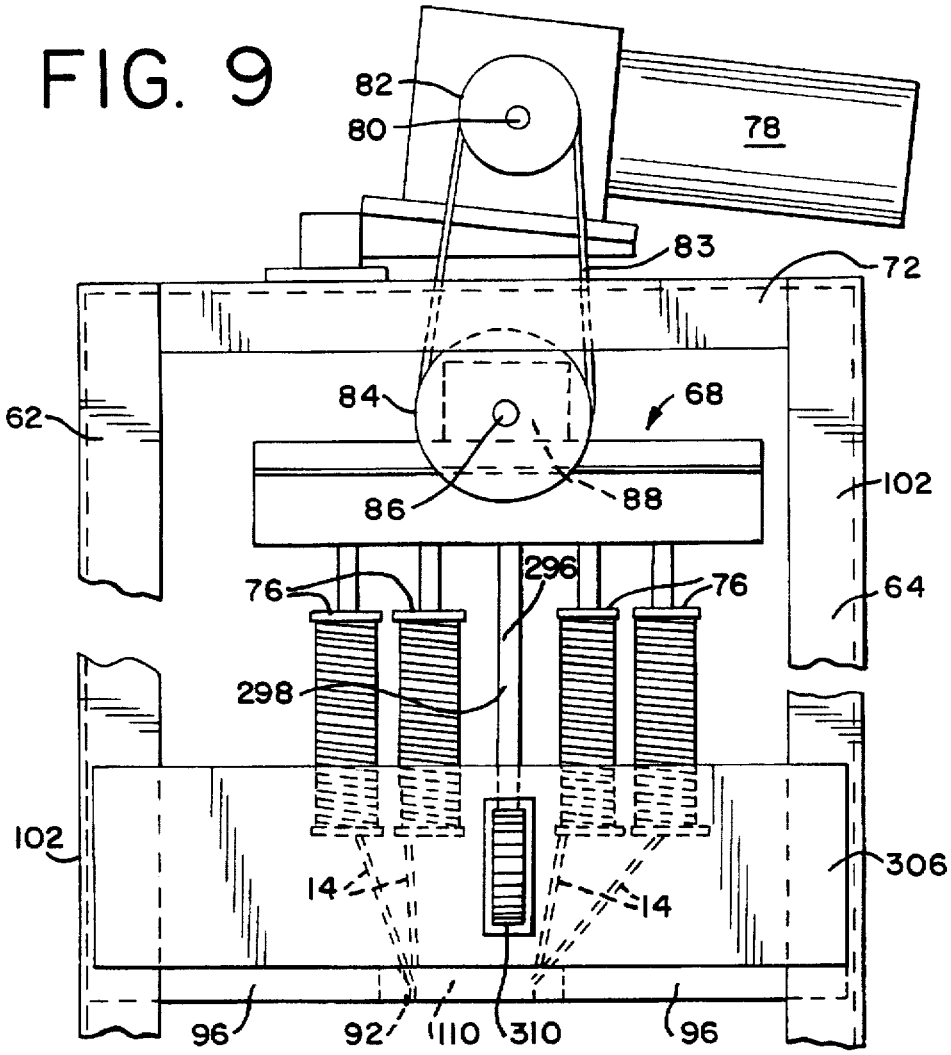
FIG. 9 is a rear elevational view of an upper portion of the apparatus in FIG. 1; again certain structure is deleted for the purpose of explanation.
Figure 10:
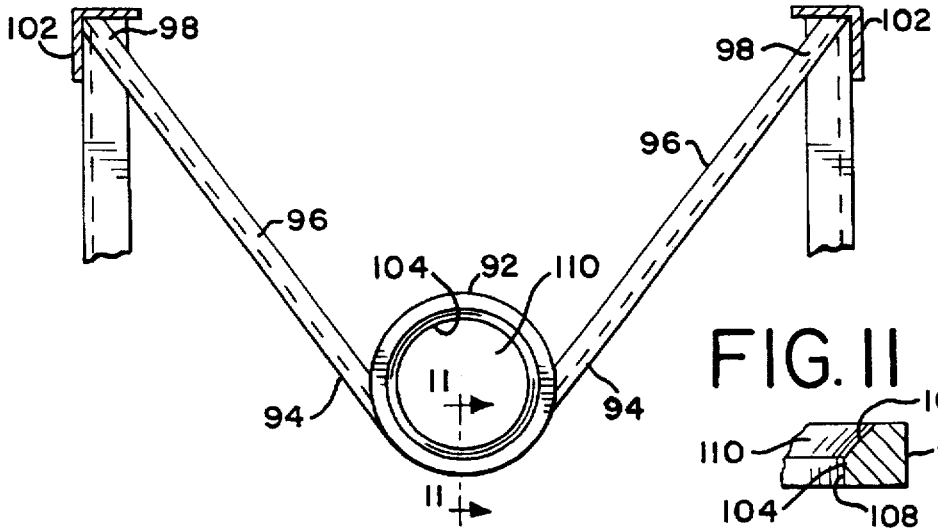
FIG. 10 is a cross sectional view as seen generally along the line 10—10 in FIG. 7; again certain structure of the apparatus is not shown for the purpose of explanation.
Figure 11:
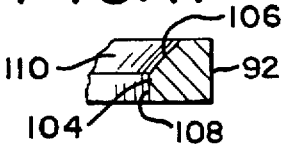
FIG. 11 is a cross section of a ring guide as seen generally along the line 11—11 in FIG. 10.
Figure 12:
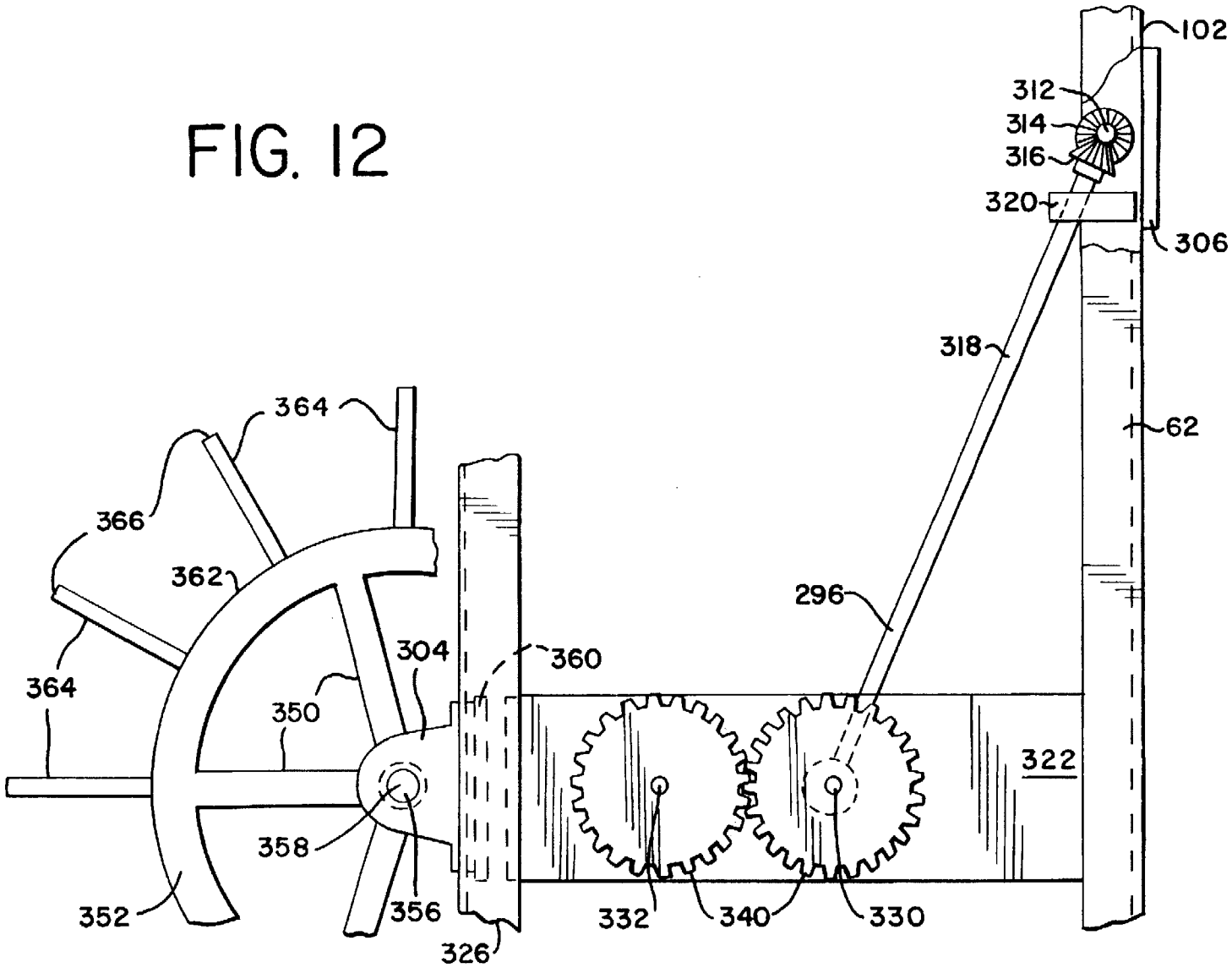
FIG. 12 is a detailed side elavational view of the apparatus of FIG. 6 showing a portion of the tension wheel assembly and a portion of drive linkage for the tension wheel assembly.
Figure 17:
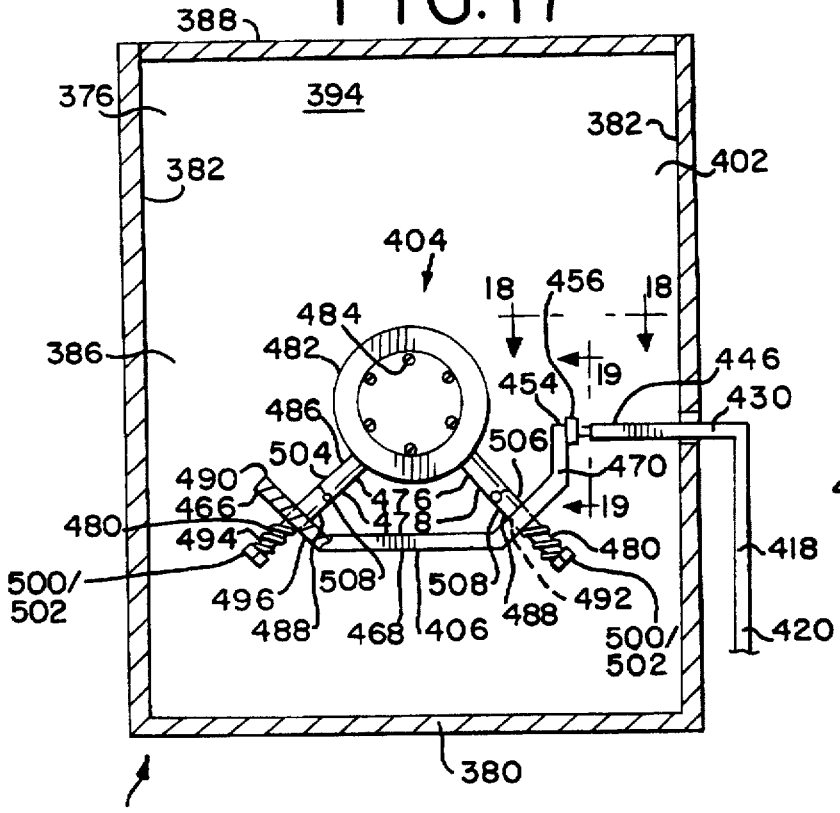
FIG. 17 is a cross sectional view as seen generally along the line 17—17 in FIG. 15 showing a portion of a napping unit of the thermo-napping station.
Figure 18:
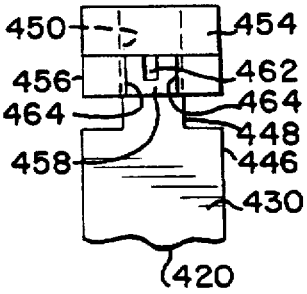
FIG. 18 is a sectional view as seen generally along the line 18—18 in FIG.17 showing a connection between a drive mechanism and a nap mechanism of the napping unit.
Figure 19:
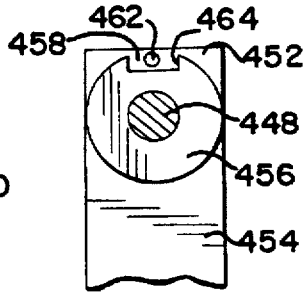
FIG. 19 is a cross sectional view as seen generally along the line 19—19 in FIG. 17 showing the drive mechanism-nap mechanism connection of FIG. 18.

Now referring to FIGS. 6, 7, and 9 the braiding station 52 includes a braiding unit 68 supported from an upper support plate 70. This support plate 70 is connected to top cross members 72 of the frame 62 by a set of couplers 74. Braiding units are commercially available. In this case the braiding unit 68 was adapted from a New England Butt Model No. NEB-16 and has eight strand carrying spools 76. To operate the unit 68 the braiding station 52 includes a 50-to-1 gear-reduced drive motor unit 78. This motor unit 78 is located above the braiding unit 68 and supported on the frame top cross members 72. A drive shaft 80 of the motor unit 78 is fitted with a drive pulley 82. This pulley 82 then is operatively connected by a belt 83 to a driven pulley 84 attached to an input shaft 86 of a gear box 88 the braiding unit 68.

As would be understood by those familiar with commercial braiding units, the unit 68 includes a guide plate 90 having a pair of crisscrossing, circular guide slots (not shown) for movement of the spools 76 during its operation.

Aligned with a vertical axis V—V passing through a center of the guide plate 90 and positioned below the spools 76 is a center of a guide ring 92, see FIGS. 6, 7, 10 and 11. This ring 92 is attached to inner ends 94 of a pair of spaced apart, horizontally positioned angle members 96. Outer ends 98 of the angles members 96 then connect respectively with rear upright members 102 of the frame 62. An inner rim 104 of the guide ring 92 has an upper chamfered edge portion 106 which joins a lower vertical edge portion 108 to define a circular opening 110 through the ring 92.

Also aligned with this vertical axis V—V is a tamping unit 114. This unit 114 includes an air cylinder 116 having an upper blind end 118 attached to the braiding unit guide plate 90. Then attached to a downward extending piston rod 120 of the air cylinder 116 is a tamping tool 122.

The tamping tool 122, shown in detail in FIGS. 13 and 14, has a cylindrical shaped body 124. The tool body 124 is formed with an upward facing threaded aperture 126 for threaded engagement with an end of the air cylinder piston rod 120. Integrally formed as part of and equispaced about a lower portion 128 of the tool body 124 is a set of four vertical ribs 130. An end 132 of each rib 130 extends below a bottom end 134 of the tool body 124 and is connected to such by an inner sidewall 136. These rib sidewalls 136 converge upward and inward on an angle to terminate about a bottom opening 138 to a passageway 140 in the tool body lower portion 128. A top opening 142 to this passageway 140 is located in an indentation 144 formed in a middle portion 146 of the tool body 124.

Located below the guide ring 92 is the insertion station 54. As shown in FIG. 6, this station 54 includes two inserter units 150, 151. Each unit 150, 151 has a drive mechanism 152 and a filament injection mechanism 154 mounted respectively on L-like shaped base plates 156. These base plates 156 in turn are connected to intermediate cross members 158 of the frame 62 by further sets of couplers 74. As is discussed later, these couplers 74 allow each inserter unit 150, 151 to be selectively positioned on the frame intermediate cross members 158.

Since the inserter units 150, 151 are identical, only the unit 150 is described. Structure of the unit 150 is shown in detail in FIGS. 21–25.

The drive mechanism 152 of the inserter unit 150 includes a rectangular shaped support block 160 which is attached to the base plate 156. On a top surface 162 of the block 160 is a pair of spaced apart sensing units 164. At an outer end 166 of a long leg 168 of the base plate 156 is an upright support plate 170 for a U-shaped bracket 172. Pivotally attached to this bracket 172 is a blind outer end 174 of a horizontally positioned drive air cylinder 176.

A piston rod 178 of this air cylinder 176 pivotally connects to a drive bar 180. An outer end 182 of the drive bar 180 then is pivotally attached to a top end of another coupler 74 with a bottom end of this coupler 74 secured to the base plate 156. As positioned between the sensing units 164, a bottom surface 184 of the drive bar 180 seats on the top surface 162 of the support block 160.

Figure 25:
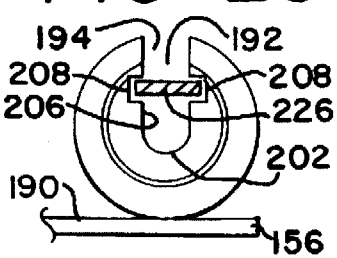
FIG. 25 is a cross sectional view of a filament injection mechanism as seen generally along the line 25—25 in FIG.
Figure 24:
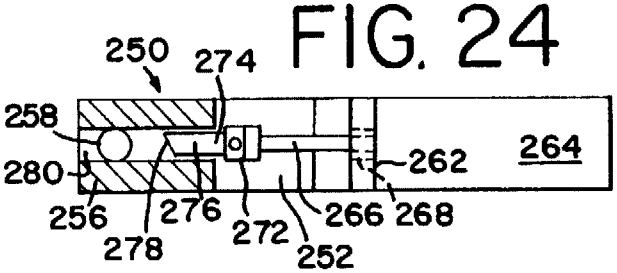
FIG. 24 in a partial cross sectional view of a filament cut-off mechanism of the inserter unit as seen generally along a line 24—24 in FIG. 21.

The filament injection mechanism 154 of the inserter unit 150 includes a guide tube 188 attached to a short leg 190 of the base plate 156. The guide tube 188 is formed with a downward extending guide slot 192. This slot 192 forms a top opening 194 in the guide tube 188 that extends from a rear end 196 of the tube 188 to a point 198 of termination near a front end 200 of the tube 188. At this termination point 198 a bottom radiused portion 202 of the slot 192 transforms into a circular passageway 204 that extends to the front end 200 of the guide tube 188. As best seen in FIG. 25, each vertical sidewall 206 of the guide slot 192 has a longitudinal notch 208 that extends between the tube rear end 196 and termination point 198.

Slidably disposed in the guide tube slot 192 is a filament carrier cylinder 210. Centrally located and attached to a top wall 212 of the cylinder 210 is rectangular shaped block 214 formed with a vertical passageway 216 that aligns with a like-sized opening 218 in the cylinder top wall 212. In an end wall 220 of the block 214 is a notch 222 to receive a front end 224 of a bar 226 slidably disposed in the pair of longitudinal notches 208 in the tube slot sidewalls 206.

Figure 21:
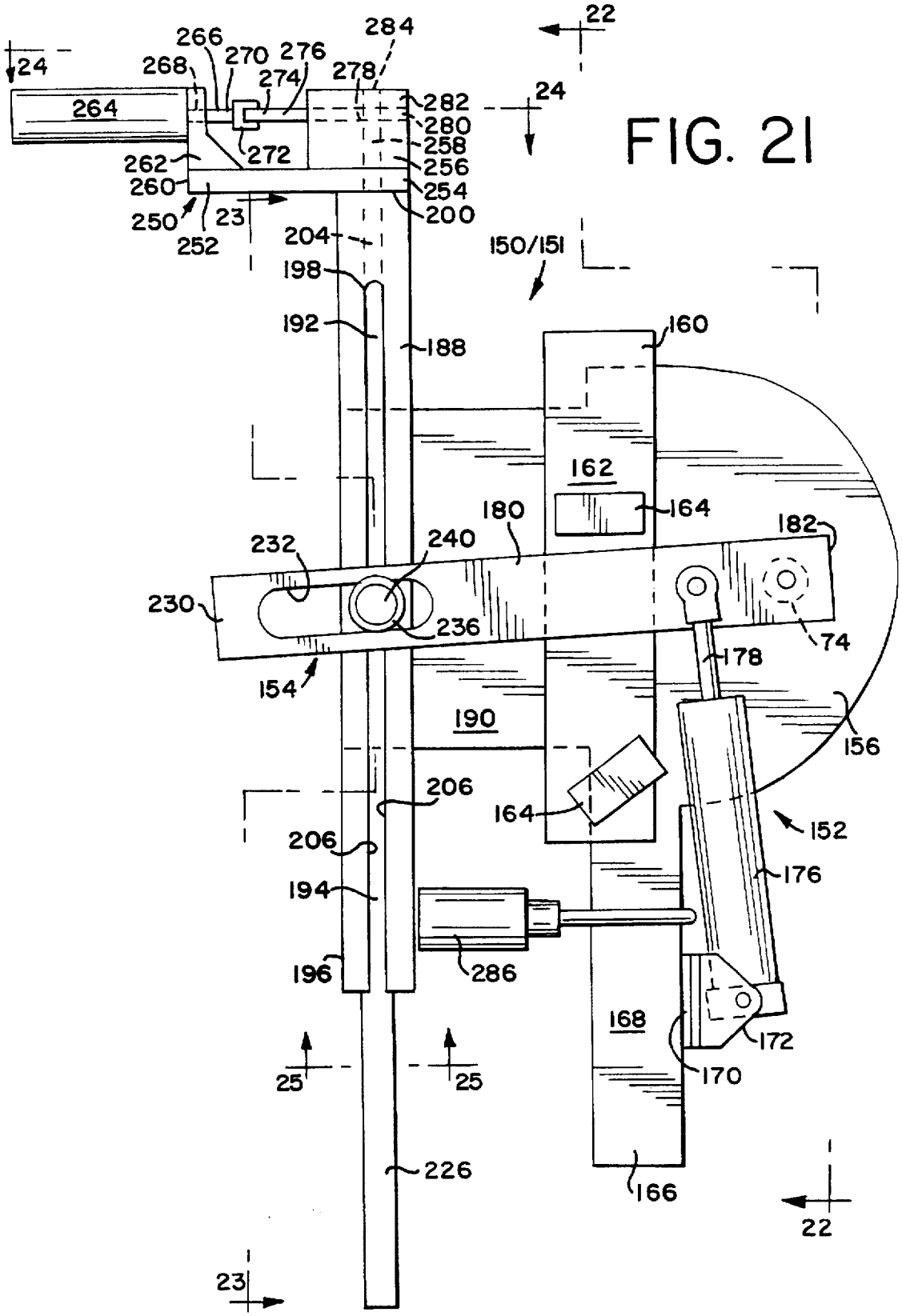
FIG. 21 is a plan view of one inserter unit of the insertion station of the apparatus of FIG. 6.
Figure 22:
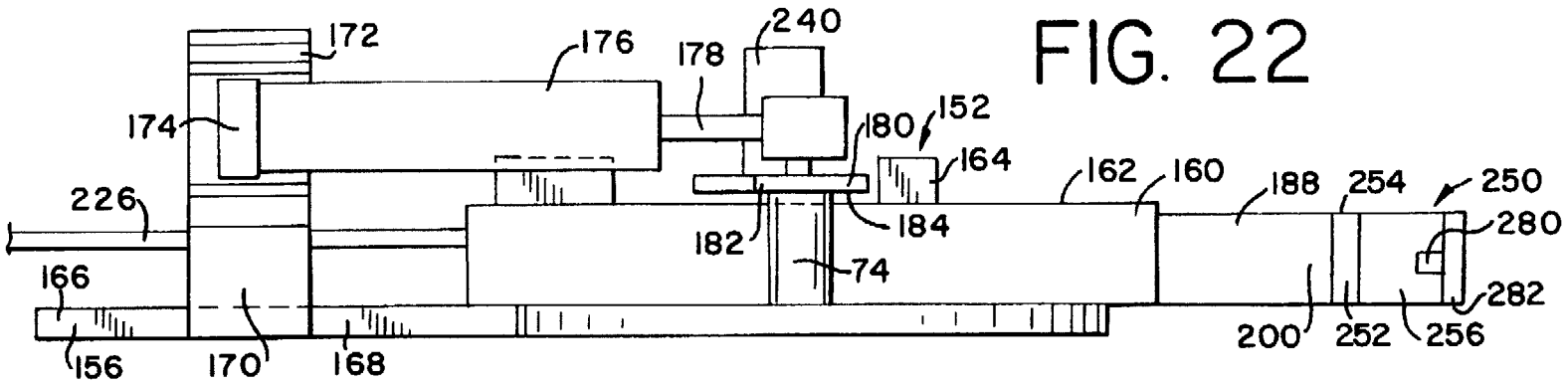
FIG. 22 is a sectional view as seen generally along the line 22—22 in FIG. 21 showing a drive mechanism of the inserter unit.
Figure 23:
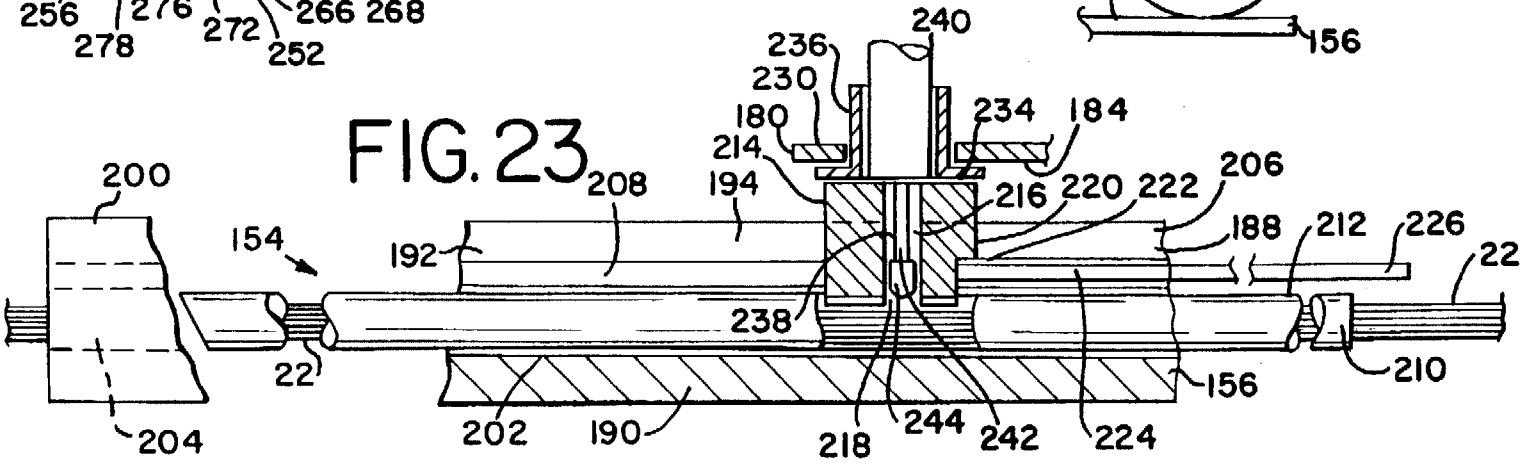
FIG. 23 is a partial cross sectional view as seen generally along the line 23—23 in FIG. 21 showing a portion a filament injection mechanism of the inserter unit.
Figures 26, 27:
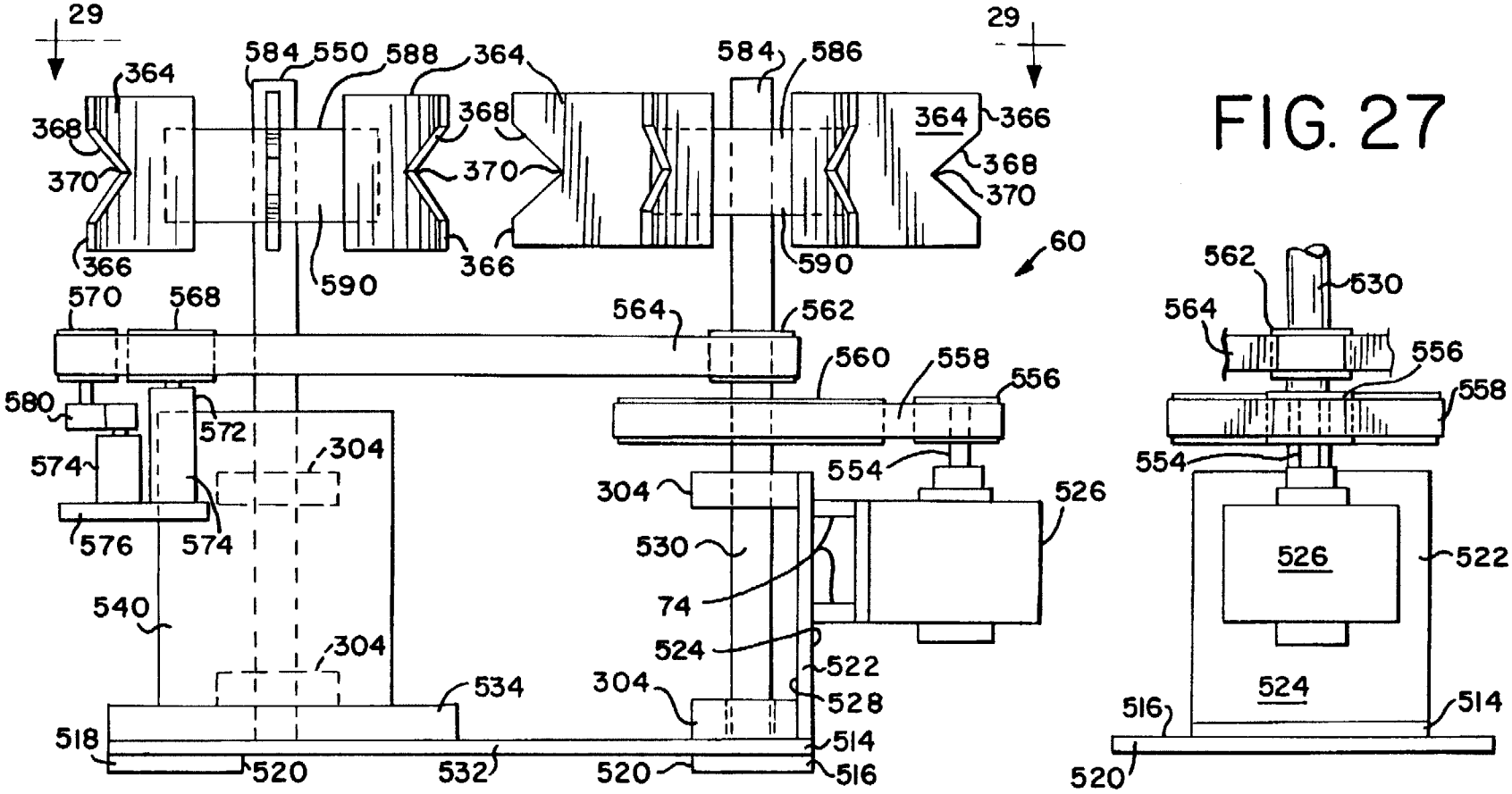
FIG. 26 is a side elevational view of a idle drive unit used with the thermo-napping station.
FIG. 27 is an elevational view of a portion of one end of the idle drive unit.

As more easily understood by viewing FIGS. 21 and 23, an inner end 230 of the drive bar 180 is formed with an elongated slot 232. Positioned in this slot 232 and secured to a top wall 234 of the block 214 is a sleeve 236 which in turn holds a first air cylinder 240. A piston rod 238 of the first air cylinder 240 then extends into the block passageway 216. On an outer end 242 of this piston rod 238 is a cap fitting 244.

Attached to the front end 200 of the guide tube 188 is a filament cut-off mechanism 250. This mechanism 250 includes a carrier plate 252 having an inner end 254 to which a knife block 256 is secured. An elongated opening 258 through the plate 252 and knife block 256 is positioned to align with the guide tube passageway 204. Connected to an outer end 260 of the carrier plate 252 is an L-shaped bracket 262 that supports an air cylinder 264. A piston rod 266 of this air cylinder 264 then extends through an aperture 268 in the bracket 262. On an outer end 270 of the air cylinder piston rod 266 is a U-shaped clamp 272 to hold an inner blunt end 274 of a cut-off tool 276. An outer knife end 278 of the cut-off tool 276 then is slidably carried in a transverse slot 280 in the knife block 256. The knife block slot 280 and block elongated opening 258 are positioned perpendicular and intersect, see FIG. 21. The knife block slot 280 is enclosed by a cover plate 282 formed with an aperture 284 that aligns with the knife block elongated opening 258.

Attached to the guide tube 188 just inward from its rear end 196 is a second filament holding air cylinder 286. In a similar manner as the first air cylinder 240, a piston rod of the second air cylinder 286 aligns with an opening in the guide tube 188 to allow movement of its piston rod into the guide tube slot 192. While not shown, an end of the second air cylinder piston rod also is equipped with a cap fitting like the fitting 244.

As shown in FIGS. 6 and 7, the rope tension wheel assembly 56 of the apparatus 50 is located below the insertion station 54. The tension wheel assembly 56 is operatively connected to the braiding unit gear box 88 by tension wheel drive linkage 296. Structure of the tension wheel assembly 56 and connecting linkage 296 is shown FIGS. 6–9 and 12.

The linkage 296 includes a vertical drive shaft 298 having an upper end 300 operatively joined to the braiding unit gear box 88. A lower end 302 of the drive shaft 298 is carried by pair of bearing blocks 304 attached to a rear vertical support plate 306. This plate 306 in turn is affixed between the rear upright members 102 of the frame 62. On the drive shaft 298 between the bearing blocks 304 is a drive worm gear 308 that engages a driven spur gear 310. The spur gear 310 is attached to an inner end of a horizontal shaft 312. This shaft 312 is rotatively supported by a further pair of spaced apart bearing blocks 304 also attached to the rear vertical support plate 306.

On an outer end of this horizontal shaft 312 is a drive bevel gear 314 which operatively interacts with a similarly configured driven bevel gear 316. The driven bevel gear 316 in turn is attached to a top end of angularly positioned intermediate shaft 318. The intermediate shaft 318 is rotatively supported by upper and lower swivel bearing supports 320. The upper bearing support 320 is attached to the rear vertical support plate 306 and the lower bearing support 320 to a side vertical support plate 322. The side vertical plate 322 is secured to a lower rear upright 324 and a lower front upright 326 of the frame 62. On a bottom end of the intermediate shaft 318 is a further drive bevel gear 314.

The side vertical support plate 322 is formed with spaced apart openings 328 for respective disposition a first and second of timing gear shafts 330, 332. The shafts 330, 332 are carried respectively by pair of longitudinal bearing supports 334 which in turn are attached to an inner sidewall 336 of the side support plate 322. On an inner end of the first shaft 330 is a further driven bevel gear 316 that mates with the drive bevel gear 314 on the intermediate shaft bottom end. Then, on an outer end of each timing gear shaft 330, 332 is timing gear 340. These timing gears 340 are similarly configured. On an inner end of the second timing shaft 332 is a pinion gear 342.

The tension wheel assembly 56 further includes a drive wheel 344 having external gear teeth 246 that operatively engage teeth of the pinion gear 342. The drive wheel 344 is connected to spokes 350 of a wheel ring 352 by another set of couplers 74. The drive wheel 346 and the wheel ring 352 of the tension wheel assembly 56 then are carried on a horizontally positioned shaft 356 having an outer end 358 rotatively carried by a still further pair of bearing blocks 304. These bearing blocks 304 are attached to a front vertical support plate 360 secured to the frame lower front upright 326.

Figure 8:
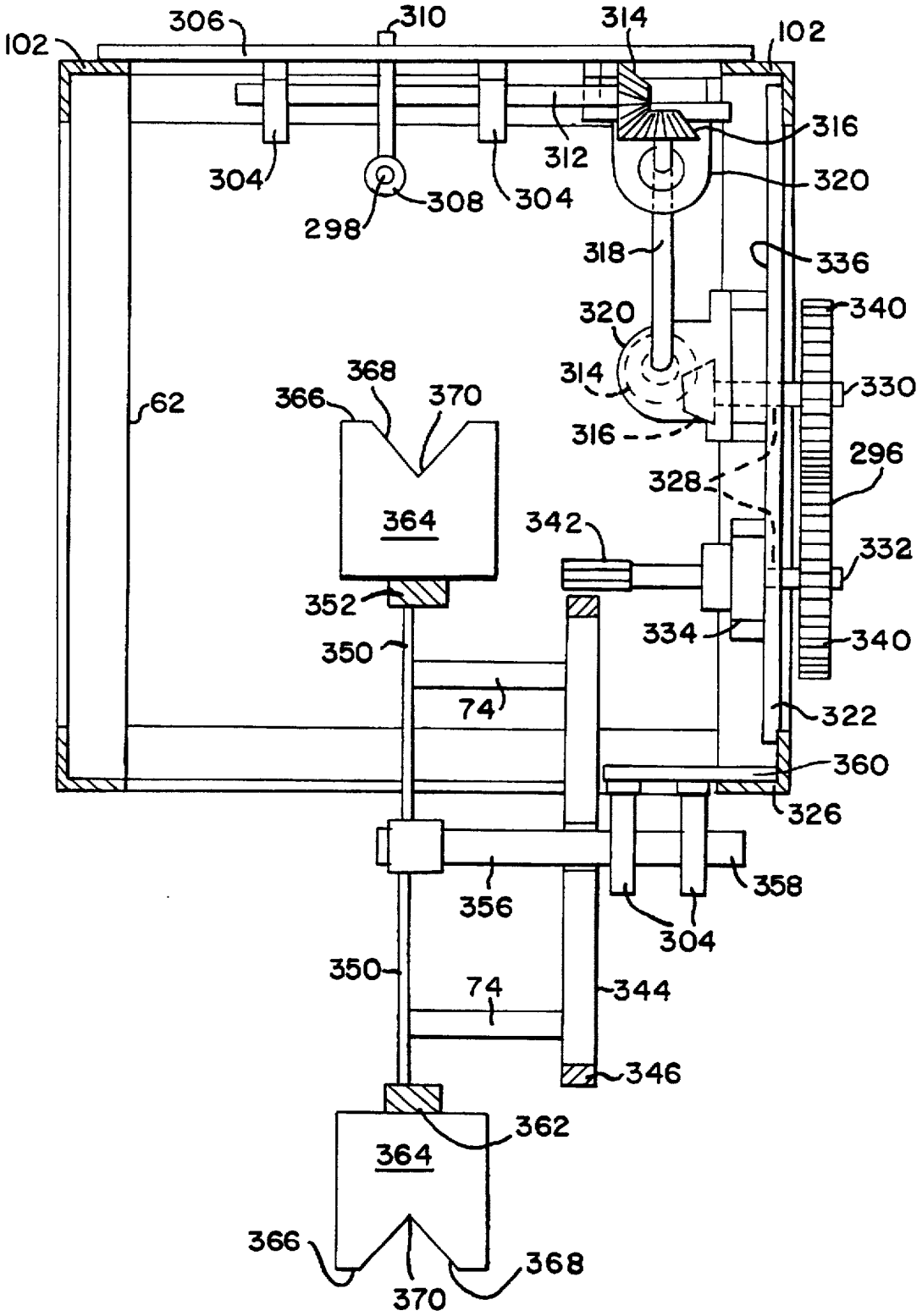
FIG. 8 in a cross sectional view as seen generally alone the line 8—8 in FIG. 7; again certain apparatus structure is deleted for the purpose of explanation.

Attached to and projecting outwardly from an outer edge 362 of the tension wheel assembly wheel ring 352 is a set of radially spaced apart plates 364. As shown in FIG. 8, each plate 364 has an outside edge 366 formed with a V-shaped notch 368. Each plate notch 368 then has an inner apex 370.

The tension wheel assembly 56 is selectively positioned on the frame 62. As a result of this positioning, when a plate 364 of the tension wheel assembly 56 is horizontal and rearward extending, the notch inner apex 370 of that plate 364 locates close to the vertical axis V—V of the braiding unit 68.

To enhance absorbent qualities of the rope 10, the apparatus 50 may operatively connect with a thermo-napping station 58 positioned adjacent to the apparatus frame 62. This station 58 is shown in detail in FIGS. 15–20 and includes an elongated heating chamber 376 carried on a framework 378 made of structural angle. The heating chamber 376 has an insulated box-like structure defined by a bottom panel 380, side panels 382, front and rear panels 384, 386 and a removable top panel 388. Both the front and rear panels 384, 386 are formed with a circular opening 390. The thermo-napping station 58 is so located that centers of the chamber front and rear panel openings 390 substantially aligned with the notch inner apex 370 of each tension wheel plate 364 when that plate 364 is in a vertical and downward extending position.

In a forward end 392 of an inner space 394 of the heating chamber 376 is a heating unit 396 comprising a pair of electrically energizable L-shaped plates 398. Located in a rear end 402 of the thermo-napping station 58 is a napping unit 404 comprising a nap mechanism 406 which operatively connects with a drive mechanism 408.

Figure 20:
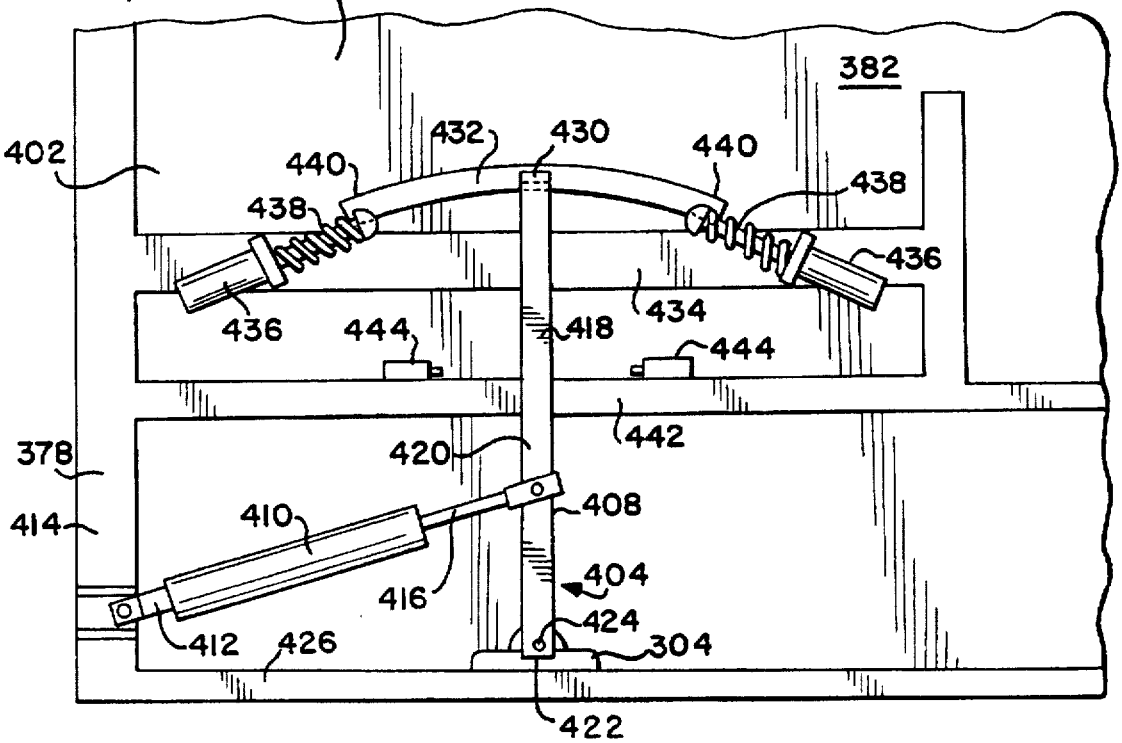
FIG. 20 is a fragmentary side elevational of a downstream end of the thermo-napping station and associated napping unit drive mechanism.

As shown in FIG. 20, the napping unit drive mechanism 408 includes an air cylinder 410 having a blind end 412 pivotally attached to a rear upright 414 of the framework 378. A piston rod 416 of the air cylinder 410 then pivotally connects to a vertical leg 418 of an inverted L-shaped pivot arm 420. Attached to a bottom end 422 of the arm vertical leg 418 is a shaft 424. This shaft 424 then is pivotally supported in a still further bearing block 304 affixed to a bottom member 426 of the framework 378.

An upper horizontal leg 430 of the pivot arm 420 extends into the chamber inner space 394 through an arcuate shaped cutout 432 in the chamber side panel 382. Attached to an upper cross member 434 of the framework 378 located immediately below the side panel cutout 432 is a pair of spaced apart adjustable cushioning units 436. Each unit 436 has a spring biased, rubber tipped plunger 438 positioned respectively adjacent to ends 440 of the chamber panel cutout 432. Therebelow, on a lower cross member 442 of the framework 378 is a pair of limit switches 444 positioned respectively on each side of and aligned with the pivot arm vertical leg 418.

As shown in FIGS. 13 and 17–19, on an inner end 446 of the pivot arm horizontal leg 430 is a circular post 448. This post 448 is pivotally carried in an opening 450 in an upper end 452 of a vertical bar 454 of a nap mechanism 406 of the napping unit 404. On the horizontal leg post 448 next to the bar 454 is a rotational control ring 456 formed with a rectangular shaped notch 458. A pin 462, extending outward from the bar 454, then fits between spaced apart vertical end walls 464 of the notch 458.

The nap mechanism 406 of the napping unit 404 further includes a pair of angularly positioned support bars 466 connected by a horizontal cross bar 468. One support bar 466 is attached to a bottom end 470 of the vertical bar 454. With respect to the cross bar 468, the support bars 466 are longitudinally offset. Near each end 472 of each support bar 466 is an angularly positioned, spring biased ring post 474.

Each ring post 474 includes an inward and upward extending stem 476 defined by an upper enlarged section 478 joined to a lower narrow section 480. A napping ring 482 having a set of inward projecting spaced apart nibs 484 is attached to an outer end 486 of each ring post stem enlarged section 478. The stem narrow section 480 extends through a sleeve 488 attached to an upper side 490 of the support bar 466 and then through an opening 492 in the bar 466 to hold a spring 494. Each spring 494 compressively seats between a lower side 496 of the support bar 466 and a washer-nut assembly 500 threaded on to an bottom end 502 of the stem narrow section 480. A lower end wall 504 of the stem enlarged section 478 and an upper end wall 506 of the sleeve 488 are each formed with a set of engaging, complementary shaped, spaced apart radiused ribs 508.

Positioned next to the rear panel 386 of the thermo-napping station 58 is the idle drive unit 60. This unit 60, shown in detail in FIGS. 26–29, comprises a base plate 514 having a first end 516 and a second end 518 supported respectively on mounts 520. Joined to the base plate first end 516 is a first upright support plate 522. Attached to an outer side 524 of this upright support plate 522 through a further set of couplers 74 is an air motor 526. On an inner side 528 of the support plate 522 is a further pair of spaced apart bearing blocks 304 which rotatively hold a first vertical shaft 530.

Along each side edge 532 of the base plate 514 at its second end 518 is an inverted angle 534 which with the base plate 514 form a pair of spaced apart, inwardly facing guide slots 536 for a slide plate 538. Attached to the slide plate 538 is a second upright support plate 540 which is positioned perpendicular to the first support plate 522. Attached to one sidewall 548 of this second support plate 540 is a further pair of spaced apart bearing blocks 304 for rotational disposition of a second vertical shaft 550.

On a drive shaft 554 of the air motor 526 is a drive sprocket 556. This motor drive sprocket 556 is operatively connected by a first timing belt 558 to a large diameter first driven sprocket 560 carried on the first shaft 530. Located above this first driven sprocket 560 on the first shaft 530 is a first small diameter drive sprocket 562. The air motor drive sprocket 556 and first shaft drive sprocket 562 are similarly configured. This first shaft drive sprocket 562 then is operatively connected by a second timing belt 564 to a second shaft driven sprocket 566 carried on the second vertical shaft 550. Both the first driven sprocket 560 and second driven sprocket 566 have a like number of timing belt teeth.

As the second timing belt 564 operatively connects the first and second shafts 530 and 550, this timing belt 564 passes over first and second idle sprockets 568 and 570. The first idle sprocket 568 has a fixed location, being attached on a top end 572 of a post 574 carried on a horizontally positioned intermediate plate 576 attached to the second upright support plate 546. The position of the second idle sprocket 570 is adjustable being carried on an outer end 578 of a horizontal bar 580. An inner end 582 of the bar 580 is pivotally attached to another post 574 also carried by the intermediate plate 576.

Attached respectively to an upper end 584 of the first and second vertical shafts 530, 550 is a first rope drive wheel 586 and a second rope drive wheel 588. Since the structure of these wheels 586, 588 is otherwise identical and plates attached to a hub portion 590 of each wheel 586, 588 are like the plates 364 of the tension wheel assembly 56, like reference numbers are used to identify like structure.

Figure 29:
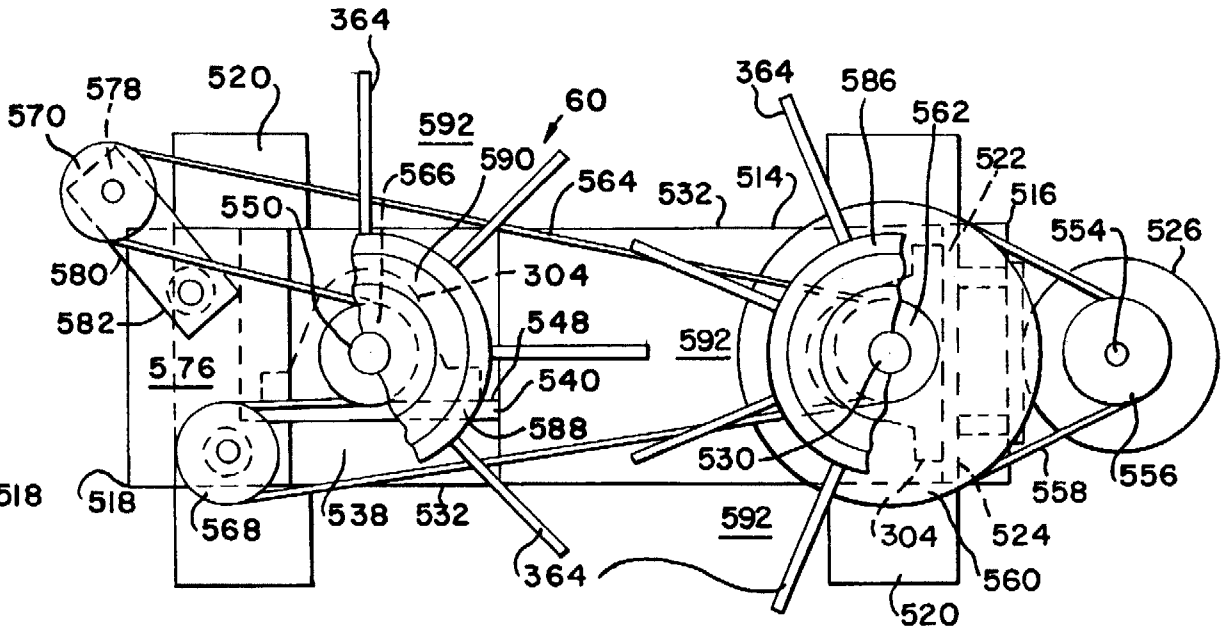
FIG. 29 is a plan view of the idle drive unit; certain structure of the idle drive unit is not shown for the purpose of explanation.
Figure 28:
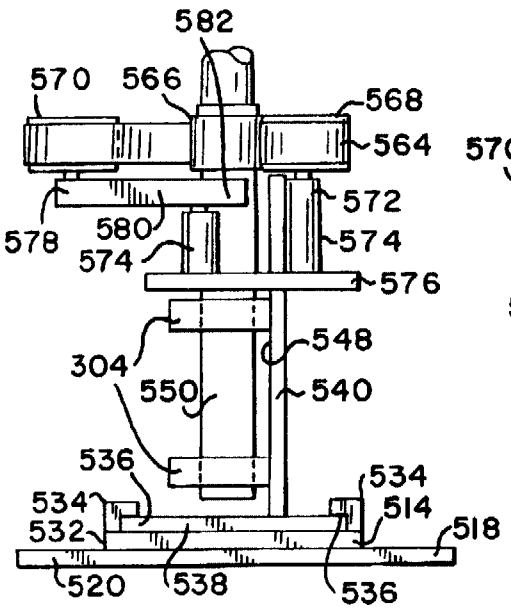
FIG. 28 is an elevational view of a portion of an opposite end of the idle drive unit.

As best seen in FIG. 29, the idle drive unit plates 364 have overlapping paths of rotation. To prevent plate contact, the plates 364 of the wheels 586, 588 are radially offset. As positioned, the plates 364 of the second wheel 588 fit into spaces 592 between the plates 364 of the first wheel 586, and the plates 364 of the first wheel 586 fit into like spaces 592 between the plates 364 of the second wheel 588.

As would appreciated from the above discussion of the structure of the apparatus 50 and understood by those familiar with the art, operative steps of the apparatus 50 are effected to a certain extent by the identified air cylinders. Air supplied to these cylinders is controlled by selective activation of air valving in a known manner. A programable controller 51, in this case a Mitsubishi Model PLC-FX-32MR-ESUL, in turn controls resprespective air valve activation in response to sensing signal inputs and timing sequences.

During operation of the apparatus 50, the braiding station drive motor unit 78 supplies rotary power through its drive shaft 80 to the braider unit gear box 88. In a known manner the gear box 88 then rotates the braider spools 78 and at the same time moves the spools 76 in selectively intersecting or crisscrossing patterns in the slots in the braiding unit guide plate 90. During this movement each of the eight spools 76 dispenses a strand 14 of a core 12 of the rope 10 at a controlled rate of about one foot per minute. As these strands 14 travel downward and converge under pulling action of the tension wheel assembly 56, the strands 14 pass through the guide ring 92. The guide ring inner rim edge portions 106, 108 insure that the strands 14 remain circumferentially aligned during this movement.

Immediately below the ring 92, the strands 14 are overlapped by crisscrossing of the spools 76 from which these strands 14 are sourced. As now crisscrossed, the strands 14 form a set 18 of two pairs of openings 20. Each pair of openings 20 is horizontally aligned and positioned proximately perpendicular to the other opening pair 20 of that set 18. The size of these openings 20 then decreases as the strands 14 join previously crisscrossed strands 14 to form the braided core 12 of the rope 10. Because the spools 76 are in a particular location as this crisscrossing occurs, a first sensor 600 on the braiding unit guide plate 90 is activated by the spools 76 as located. Activation of this sensor 600 produces an signal input to the controller 51, discussed above, that in turn produces an output that activates of the drive air cylinder 176 of the insertion station first inserter unit 150.

The air cylinder piston rod 178 moves outward to swing the inserter unit drive bar 180 and attached filament carrier cylinder 210 forward. Inside the carrier cylinder 210 is a filament length 22 supplied from a source spool (not shown) external of the apparatus 50. An end portion 28 of the filament length 22 is located adjacent to the cut-off tool knife end 278. Concurrently, the injection mechanism first air cylinder 240 is activated so that its piston rod cap fitting 244 engages and holds the filament length 22 against the carrier cylinder 210. During activation of the drive air cylinder 176 and the first air cylinder 240, the piston rod 288 of the horizontal second air cylinder 286 remains retracted. Thus, the length of filament 22 is free to move with the carrier cylinder 210 as it slides forward in the guide tube slot 192.

As the first inserter unit 150 is positioned, the filament end 28 is pushed by movement of the carrier cylinder 210 though one of the just formed pair of strand openings 20 of the rope core 12. As the carrier cylinder 210 advances, the length of filament 22 located immediately outside of the guide tube rear end 196 is drawn into the guide tube 192. The top opening 194 of the guide tube slot remains covered by the carrier cylinder bar 226 during this movement. Carrier cylinder movement terminates when the drive bar 180 engages the second sensing unit 164 of the first inserter unit 150.

Drive bar-second sensing unit engagement sends a signal to the controller 51 which then produces a number of operative responses. First, the piston rod 238 of the injection mechanism first air cylinder 240 is retracted; secondly, the piston rod of the second horizontal air cylinder 286 advances to engage the filament 22; and third, the drive air cylinder 176 is activated to slide the drive bar 180 back across the block 160 toward the first sensing unit 164.

During retraction of the carrier cylinder 210 and attached carrier cylinder bar 226, the carrier cylinder 210 passes over the length of filament 22 just pulled into the guide tube slot 192. Any buckling of the filament length 22 during retraction of the carrier cylinder 210 is prevented by the bar 226 located thereabove. Additionally, longitudinal movement of the filament length 22 in the guide tube slot 192 is inhibited by engagement of the piston rod cap fitting on the piston rod of the second air cylinder 286 with the filament length 22.

When the inserter unit drive air cylinder 176 is fully retracted, the drive bar 180 again locates against the first sensing unit 164. This proximity produces a further signal to the controller 51 that in turn activates the air cylinder 264 of the filament cut-off mechanism 250. The air cylinder 264 advances the cut-off tool 276 to sever the length of filament 22 in the knife block opening 258. The controller 51 then reactivates the cut-off air cylinder 264 to retract the cut-off tool 276. Note that the length of the filament segment 24, typically 4 inches, remaining into the rope core openings 20 may be increased or decreased. This change is made by relocating the insertion units 150, 151 on the frame cross-members 158 and then adjusting the location of the second sensing unit 164 on the support block 160.

Upon completion of the operating cycle of the first inserter unit 150, the second inserter unit 151 is activated to place a further filament segment 24 in the other pair of openings 20 in that set 18 of openings 20 in the rope core 12. Note that the second inserter unit 151 has been positioned to align its guide tube 188 with the other pair of core openings 20. The second inserter unit 151 operates in a like manner as first unit 150.

During and after filament segment insertion the size of the core diameter and the openings 20 in the rope core 12 continuously contract from pulling action on the rope 10 by the tension wheel assembly 56. Action of the tension wheel assembly 56 is discussed in greater detail below. Contraction continues until the strands 14 form compressive fits 46 about the just placed filament segments 24.

Formation of these compressive fits is supplemented by activation of the tamping unit 114. The tamping unit air cylinder 116 lowers the tamping tool 122 so that the rib ends 132 and rib sidewalls 136 of the tool 122 engage the just crisscrossed pairs of strands 14. This engagement further tightens the strands 14 about the filament segments 24. The tool 122 then is retracted to await the next set of strand crisscrossing and filament segment insertions.

It should be pointed out that while the pairs of openings 20 in one opening set 18 are radially offset from the openings 20 of adjacent sets when the rope core 12 is in its final form, initially these openings 20 are similarly positioned. Therefore, only two inserter units 150, 151 are required. Also, no repositioning of the tamping tool 122 is required.

If mastic 48 is to be added to a rope core 12 to supplement the compressive fits 46 holding the filament segments 24 between the strands 14, this mastic 48 is injected in response to a further controller output. Mastic 48 flows down a tube 610, see FIG. 13, located in the tamping tool passageway 140. An upper end 612 of the tube 810 connects with a mastic source (not shown) while its lower end 614 extends into an inner space 16 of the rope core 12 below the just formed compressive fits 46. To prevent damage to the tube 610 by movement of the filament carrier cylinders 210, the tube 610 is fitted with a protective sleeve 616. The preferred mastic 48 is a solvent-free polyisocyanate urethane from United Resins.

During the above described operation of the insertion station 54, the braiding unit spools 76 continue to circle about the unit guide plate 90. The spools 76 again intersect to selectively crisscross the strands 14 to form a next set 18 of aligned pairs of openings 20. When this occurs, certain spools 76 are proximate to a braiding unit second sensor 602. A second sensor output to the controller 51 starts a next full cycle of the insertion station 54 and tamping unit 114.

Movement of the rope 10 through the insertion station 54 is a result for the most part from a pulling action on the rope 10. This pulling action ensues from rotational engagement of the plates 364 on the wheel ring 352 of the tension wheel assembly 66 with the rope 10. During wheel ring rotation the plates 364 selectively slide through the filament segments 24 to locate respective plate notch inner apexes 370 next to the rope core 12.

As may be remembered, the tension wheel assembly 56 is operatively connected to the braiding unit gear box 88 by the tension wheel drive linkage 296. This linkage 296 regulates the peripherical speed of the plates 364 so that the plates 364 maintain a constant pulling action on the rope 10. As required, plate speed may be adjusted by changing the configuration of the timing gears 340.

The rope 10 partially encircles the wheel ring 352 of the tension wheel assembly 56 to begin separation therefrom at the bottom most point of the wheel ring 352. Upon leaving the tension wheel assembly 56, the rope 10 may be coiled onto a spool 594 for future shipment and use. Alternately, where the rope 10 is to have enhanced absorbing qualities, the rope 10 is drawn through the thermo-napping station 58, see FIGS. 15–20, by the idle drive unit 60, see FIGS. 26–29. In this latter case the filament segments 24 typically are a synthetic, interconnected fibrous material.

The rope 10 enters the heating chamber 376 of the thermo-napping station 58 through the opening 390 in the front panel 384. The energized heating unit plates 398 raises the temperature of fibers 30 of the rope filament segments 24 to about 140 deg. F. as the rope 10 passes through the heating unit 396. At this temperature the fibers 30 of the filament segments 24 soften. Because the heating chamber 376 is insulated, the filament segments 24 remain in this softened condition while in the heating chamber 376.

Next the rope 10 is drawn through the napping rings 482 of the nap mechanism 406 of the napping unit 404. During rope movement, the napping rings 482 are reciprocated back and forth over the rope softened filament segments 24 by selective activation the air cylinder 410 of the napping unit drive mechanism 408. Each time the napping unit drive mechanism 408 reaches an end of either the forward or rear stroke of its cycle, the vertical leg 418 of the pivot arm 420 engages one cushioning unit plunger 438. This interaction reduces the shock effect on the drive mechanism 408 and on the nap mechanism 406. At the same time the pivot arm 420 respectively engages one limit switches 444 which with the controller 51 activates the air cylinder 410 to reciprocate the pivot arm 420.

Movement of the rings 482 over the fibers 30 of the filament segments 24 remains substantially aligned with the horizontal path of movement of the rope 10. While the path of movement of the pivot arm horizontal leg 430 is arcuate, the pivot connection between the drive mechanism leg post 448 and the nap mechanism vertical bar 454 allows the rings 482 to remain horizontal. At the same time the napping rings 482 move vertically up and down a short distance. Nap mechanism rotation from the horizontal is limited by engagement of the post pin 462 with the control ring notch end walls 464.

The angular position of each rings 482 with respect to the movement path of the rope 10 is adjustable. Pulling a ring 482 outward compresses the spring 494 and disengages the ribs 508 on the stem end wall 504 from the ribs 508 on the sleeve end wall 506. In this extended position the ring 482 may be rotated to locate the ring 482 perpendicular to the path of rope movement or angularly offset thereto. Filament fiber crimping and expansion is increased when the rings 482 are offset. The rope 10 departs the thermo-napping station 58 through the opening 390 in the rear panel 386 of the heating chamber 376 having its now crimped and expanded filament segment fibers 30 formed into a high absorbency array 34.

Positioned downstream from the thermo-napping station 58 is the idle drive unit 60 where the rope 10 is threaded between the plates 364 of the first and second drive wheels 586, 588. As operated by the air motor 526, these wheels 586, 588 rotate to insert their plates 364 through the rope filament array 34 so that respective plate notch inner apex points 370 locate next to and on each side of the rope core 12. At one time the rope 10 typically is gripped by two plates 364 of each the first and second wheels 586, 588.

Note that even if there were no rope movement, the air motor 526 continues to operate and maintain tension on the rope 10. Rotation of the motor drive sprocket 556 only occurs when the tension wheel assembly 56 is delivering rope 10 to the thermo-napping station 58 for a 10 minute passage therethrough. The applied tension is not sufficiently great to damage the rope 10. Rope delivered from the idle drive unit 60 may be coiled onto another spool 594 for subsequent use or shipment.

To accommodate ropes 10 having different length filament segments 24 or different diameter rope cores 12, the distance between the plate notch inner apex points 370 may be increased or decreased. This adjustment is made by moving the slide plate 538 in the guide slots 536 which in turn relocates the second vertical shaft 550 and second rope drive wheel 588. The position of the bar 580 and its idle sprocket 510 then is adjusted to maintain proper tension on the second timing belt 564.

While embodiments, uses and advantages of the method and apparatus of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A method for forming a filament rope comprising the steps of:

step a. overlapping pairs of strands to form a core of said rope having pairs of aligned openings defined by said strands, said step a. including a braiding station having a braiding unit to supply said strands from rotating source spools that overlap said strands, step b. inserting filament segments in said pairs of said aligned openings, said step b. including an insertion station located downstream from said braiding station to place said filament segments into said strand defined openings as said rope core passes therethrough, and step c. applying a pulling force on said core to reduce a size of said strand defined openings until said strands engage said filament segments and form compressive fits about said filament segments to hold said filament segments, said step c. including a tension wheel assembly located downstream from said insertion station to engage said rope and provide said pulling force on said rope core sufficient to effect said compressive fits, wherein said method forms said rope continuously to have a consistent, high filament segment density.

2. A method as defined by claim 1 and further including the step of, d. applying a tamping force to said strands defining said set of openings just receiving a filament segment insertion, said tamping force enhancing said formation of said compressive fits by said respective strands.

3. A method as defined by claim 2 and further characterized by step d. including, a tamping tool positioned between said braiding station and said insertion station to provide said tamping force.

4. A method as defined by claim 2 and further including the step of, e. applying mastic to said compressive fits immediately after application of said tamping force, wherein said mastic augments said compressive fits to secure said filament segments to said core.

5. A method as defined by claim 4 and further characterized by said step e. including, a tube for applying said mastic, said tube having an upper end prepared to connect to a source of said mastic and a lower end fitting in a hollow inner space of said core.

6. A method as defined by claim 1 and further including the steps of, d. applying heat to said filament segments to soften said segments, and e. napping said softened filament segments to expand and crimp fibers of said filament segments and form randomly spaced, irregular shaped interstices between said fibers, wherein said filament segments form an absorbent array about said rope core.

7. A method as defined by claim 6 and further characterized by, steps d. and e. including a thermo-napping station having a heating unit to effect said filament segment softening and a napping unit to effect said filament fiber expansion and crimping.

8. A method for making an filament rope, said method comprising the steps of:

a. crisscrossing strands to form a braided rope core having longitudinally spaced apart sets of pairs of aligned openings defined by said crisscrossed strands, b. inserting filament lengths in said respective pairs of said rope core aligned openings, and c. applying a pulling force on said rope core during step a. and step b. to move said rope core and inserted filament lengths and reduce a size of said rope core openings so that said defining strands engage and form compressive fits about said filament lengths, wherein said method continuously produces a increasing length of said filament rope.

9. A method as defined by claim 8 and further characterized by including the steps of, d. softening said filament lengths carried by said rope core, and e. napping said softened filament lengths to produce crimps in said filaments, wherein said crimped filament lengths form an absorbent array about said rope core.

10. A method for forming an absorbent rope, said method comprising the steps of:

a. operating a braiding station comprising a braiding unit having rotating, crisscrossing spools dispensing strands forming a braided rope core having longitudinally spaced apart sets of pairs of aligned openings defined by said strands, b. operating an insertion station having an inserter unit placing filament lengths in said pairs of openings in said rope core, c. operating tension wheel means engaging said rope core and filament lengths downstream from said insertion station and drawing said rope core through said insertion station, said drawing reducing a size of said rope core openings so that said defining strands engage and form compressive fits that hold said filament lengths, d. operating a tamping tool engaging said rope core strands forming said openings having said filament lengths just inserted therein to promote formation of said compressive fits, and e. operating a thermo-napping station receiving said rope core and filament lengths from said tension wheel means, said thermo-napping station softening, crimping, and expanding said filament lengths to create an enhanced absorbent array about said rope core.

* * * * *